United States Patent [19]

Feil et al.

[11] Patent Number: 4,800,675

[45] Date of Patent: Jan. 31, 1989

[54] ROOFING PLATE FOR PLANTING GREENERY ON ROOFS

[76] Inventors: Eugen Feil, Lange Strasse 29, D-7084 Westhausen; Gerd Neumann, Attenzell 50, D-8079 Kipfenberg; Wolfgang Graser, Mittelsetzring 56, D-8729 Zeil; Horst Friedrich, Kriegsreuth, D-8662 Helmbrechts, all of Fed. Rep. of Germany

[21] Appl. No.: 71,439

[22] Filed: Jul. 9, 1987

[30] Foreign Application Priority Data

Jul. 12, 1986 [DE] Fed. Rep. of Germany ..... 3623562

[51] Int. Cl.[4] ..... A01G 1/00; E04D 1/00

[52] U.S. Cl. ..... 47/33; 47/66; 47/84; 52/27; 52/90; 52/519; 52/546

[58] Field of Search ..... 47/33, 66, 67, 82, 83; 52/518, 519, 543, 542, 546, 550, 552, 96, 27, 90; 405/284–287

[56] References Cited

U.S. PATENT DOCUMENTS 1,979,862 11/1934 Cannon ..... 52/542

FOREIGN PATENT DOCUMENTS 916241 8/1954 Fed. Rep. of Germany ..... 47/82
17266 12/1965 Fed. Rep. of Germany .
2349710 6/1977 Fed. Rep. of Germany .
2842347 3/1980 Fed. Rep. of Germany .
3102083 8/1982 Fed. Rep. of Germany ..... 52/518
3301954 7/1984 Fed. Rep. of Germany ..... 52/90
3441316 11/1984 Fed. Rep. of Germany .
3416208 11/1984 Fed. Rep. of Germany .
181432 6/1985 Fed. Rep. of Germany .
3527058 2/1987 Fed. Rep. of Germany ..... 47/67
511177 12/1920 France .
592220 10/1977 Switzerland ..... 52/90
2141157 12/1984 United Kingdom ..... 52/518

*Primary Examiner*—James R. Feyrer
*Attorney, Agent, or Firm*—Dority & Manning

[57] ABSTRACT

A roofing plate for the planting on greenery on a roof, having an approximately rectangular surface as seen from above. The roofing plate comprises a wedge-shaped upper section tapering in thickness towards the ridge, a central section of uniform thickness and of a lower section with an open channel on top. The combined length of the central section and the lower section (measured in the direction of the ridge to the eaves) is greater than the length of the upper section, so that a scale-like double or multiple roof covering can be installed. Several rows (25, 26) are installed one above the other, whereby a plurality of open channels are formed, and are located one above the other, are filled with a nutritive medium (35) for the planting of greenergy (36). Shell sections (32) are preferably inserted into the channels and hook into each other by means of beads and creases (33) so as to form a strong, sealed connection.

13 Claims, 3 Drawing Sheets

ROOFING PLATE FOR PLANTING GREENERY ON ROOFS

BACKGROUND OF THE INVENTION

The instant invention relates to a roofing plate made of a heat-insulating material for the planting of greenery on a roof.

An insulating board for the construction of a sub-roof which is built up similarly to roofing tiles and which is hung from a roof batten by an upper projection is known in DE-GM No. 1,932,832. An insulating board installed above overlaps the insulating board installed below over a short, upper area. Roofing tiles are hung from the insulating board by their projection from a crosspiece. Overlapping profiles are attached to the lateral edges of the insulating board to provide water-tightness at the lateral butt joints.

The thinness of the insulating boards creates a risk that the boards may be damaged on open construction sites, so that the sub-roof becomes permeable to water and low-temperature bridges are created. Today, relatively thick insulating layers are required, and the known boards are not well suited for. Surfaces have to be given an excessive and undesirable step configuration, creating the danger in steep roofs that the boards are precariously balanced because of the high tipping moment, and in flat roofs the danger that water may back up.

No mention is made of planting greenery on a roof in the context of the above known insulating boards.

In another insulating board for the construction of a sub-roof, known in DE-PS No. 23 49 710, the board engages between the roof battens and is supported on its lateral surface pointing to the eaves on the lower roof batten. An overlapping edge profile of complicated configuration is required here to ensure that the sub-roof is water-tight. Since the batten intervals vary from manufacturer to manufacturer, measuring for instance from 32 cm to 36 cm with roof pans, insulating boards of different dimensions must be used. This means special expense in the manufacture of, planning, storage of such boards. In connection with these insulating boards there is also no provision for planting greenery on a roof.

The planting of greenery on a roof can be required or useful for camouflage purposes in the military, for an improvement of the environment in urban areas, public buildings, or as an outstanding architectural element. For this purpose, mats of nutritive material are simply laid over existing roof surfaces and are fastened. Such mats last only for a limited time and must then be replaced. A sightly, lasting installation is not achieved in this manner.

Another known method for the planting of greenery on a roof consists in setting up individual boxes, vats, or the like designed especially for each application, on the roof, and to combine them with the substructure of the roof. This is expensive and time consuming, especially because of the great number of required connections to achieve tightness.

Another known roofing plate for planting greenery on a roof is in the form of a double depression interlocking tile or a roof pan with profiled edges which overlap when installed is disclosed in DE-OS No. 3,416,208. Near the lower end of the roofing tile a container, open on top, is built in to receive a nutritive medium for planting greenery on a roof. It is not possible to install a heat-insulated roof with such known roofing plates.

To obtain heat insulation, additional measures would be necessary, such as for example, installing a sub-roof of insulating boards.

SUMMARY OF THE INVENTION

In view of the above it is the object of the instant invention to create a roofing plate for supporting the planting of greenery on a roof, by means of which, in addition to planting greenery on a roof, a heat-insulated roof is created, where the roofing plates or insulating boards are simple in form, and provide an insulating layer of approximately uniform thickness and a tightly sealed roof.

The roofing plate is made of an insulating material, for example a rigid, expanded polyurethane, mineral fibers or similar materials. The portion of the plate visible from the outside of the roof and/or the channel can be covered or lined in advance by foils, sheet-metal inserts, or the like. Preferably, edges overlap in the direction of the slope so as to constitute a closed protective layer and outer roof skin. Coatings or coverings are also proposed as a vapor barrier or to provide fire protection.

The configuration of the plate makes it possible to obtain a scale-like double or multiple overlapping providing absolute water-tightness. In its detail, the roofing plate of the invention consists of three (imaginary) parts, a wedge-shaped upper section pointing in the direction of the ridge when installed, a central section and an lower section. The central section is a extension of the upper wedge surface of the upper section and is of uniform thickness. The underside of the lower section, pointing toward the eaves when installed, is an extension of the underside of the central section. At least one channel, extending transversely to the roof, is formed on the upper side of the lower section to receive a nutritive medium for sustain planting greenery on a roof.

Furthermore, the combined length of the central and lower sections (measured in the direction of the ridge-eaves) is greater than the length of the upper section, so that a scale-like, double or multiple overlapping can be achieved. The width of the plate can be of any selected dimension which would be suitable and advantageous from the point of view of manufacturing technology and installation. The overall length of the plate depends upon the number of fastening points or support points, e.g. battens, which are to be bridged by one plate, upon the number of overlapping layers desired, the thickness of insulation through the roofing plate and the like.

Water tightness of a sub-roof constituted by the roofing plates according to invention, is achieved by means of offset installation of the lateral abutments, and through the double or multiple overlapping of the plates in the direction of the slope. The very long and wide overlap also ensures great wind tightness.

Since the central section of the roofing plate is always covered by the next overlapping plate above it when installed, the plate can be fastened there by means of a simple fastening means, e.g. a wide head nail, in a storm proof manner without low-temperature bridges or danger of corrosion.

Due to the wide overlap and the offset installation, neither broken-off edges nor holes cause water to leak through or a complete loss of insulation in the area concerned. Furthermore, no complicated and easily damaged lateral interlocking devices are required for water guidance or drainage. A plate configuration with a smooth underside of the upper section can be installed directly onto timbering and, in appropriate width, on rafters or the like.

In addition to the water-tight sub-structure, transverse channels are created on the roof and lie one above each other in rows according to the design of the roofing plates, according to invention, so that they can support a nutritive medium to plant greenery on the roof. The channels can be filled in a particularly advantageous manner if the desired nutritive medium (e.g. a mixture of soil and turf) is prefabricated in form of a hose and is provided with the seeds of the desired greenery whereby these hoses are then laid into the channels. Such a hose could, for example, be provided with a wide mesh burlap wrapping and an additional outer plastic foil wrapping, the plastic foil being removed during the installation on the roof. This makes it possible to fill the channels with an optimal nutritive medium practically free of impurities.

By means of individual elements of roofing plates on hand, it is also possible to create a desired green surface within a roof covered with conventional roofing material. It is therefore also possible to lay out large-scale patterns, lettering, and the like on roofs in a simple, easy to plan manner. The roofing plates, according to the invention, can be combined with similarly made roofing plates to produce a sub-roof.

The roofing plate, according to the invention can also be used to catch snow, when arranged in transverse rows, one after the other, or can be used to provide a standing support if appropriately covered. Since the transverse channels receives rain water when greenery is planted but drains rain water off laterally, if not filled, the channels can also be used as a gutter.

According to the invention, a step-shaped crosspiece is attached to the underside of the upper section of the roofing plates by which the roofing plates can be hung from a substructure of battens or metal angles. Since the plates can be shifted in relation to each other in the direction of the slope, and because of the wedge-shaped configuration, the same plates can be used with different batten intervals. The crosspiece is offset in steps in the direction of the eaves, but can go over in a sightly manner, in a curve, into the wedge shape of the upper section.

According to the invention, the channel is formed in a simple manner by a crosspiece at the edge and at least one additional crosspiece offset with respect to it. This makes it possible to obtain different channel configurations such as box channels or channels with round cross-section surfaces.

It is especially advantageous for the crosspiece at the edge to be higher so that the channels lie in a nearly horizontal position when the roofing plates are installed on a sloped roof and they flatten out towards the ridge.

This flattening out is favored by the drop-off of the upper crosspiece at the edge.

Especially when additional channel or shell sections are used, it is advisable to have drainage grooves extending in the direction of the slope and going through the channel structure on the roofing plate, so that no water can accumulate behind the crosspieces. As can be seen, the crosspieces are thereby interrupted and hump-like rises are formed into which additional groove elements can be inserted, for example. The distance between these humps, i.e. the width of the drainage grooves must then be selected so as to ensure mechanical strength and support for groove sections that may yet be inserted.

To improve wind tightness, a special configuration of the plate edges is provided.

Universal roofing plates which can be used with all the conventional batten intervals is created by making them in the dimensions indicated.

If the roofing plate, according to invention, is made of an insulating material, e.g. rigid extruded polyurethane, there is a danger that roots of the plates may dig their way into the roofing plate or into spaces between plates when greenery is planted thereon, possibly affecting the tightness of the roof structure. It is therefore proposed that shell sections or a second channel made of a synthetic material, sheet metal, ceramic or asbestos cement, be inserted into the channel of the roofing plate, so that the built-in channel of the roofing plate is thus protected and covered. Suitably, the same channel configuration as that of the built-in plate channel is used in the shell sections. However, it is also possible to use shell sections with several channels, covering several rows of roofing plates at a time.

The channels used should overlap each other and be provided with beads or creases so that they can be interlocked and can be attached together along their length without special fastening means.

Similar standard elements with flanges, crimps, or the like can be used for lateral connections of the planted surface, or for its connection to the roof.

BRIEF DESCRIPTION OF THE DRAWINGS

The invention, its characteristics and advantages, are explained in further detail through an embodiment shown in the drawings where.

DETAILED DESCRIPTION OF THE DRAWINGS

Figure 1:
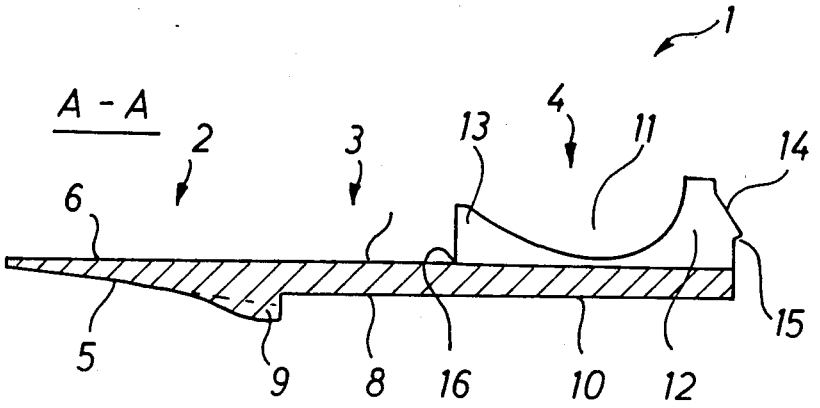
FIG. 1 shows a longitudinal section taken along line A—A of FIG. 2 through a roofing plate.

FIG. 1 shows a longitudinal section through a roofing plate 1 which consists of an upper section 2, pointing to the ridge, a central section 3 and a lower section 4, pointing to the eaves.

The upper section 2 is shaped as a wedge, has a lower wedge surface 5 and an upper wedge surface 6. The upper side 7 of the central section 3 is an extension of the upper wedge surface 6. An underside 8 of the central section 3 runs parallel to the upper side 7, whereby the thickness of the central section 3 of the roofing plate is determined, thickness being less than the wedge thickness of the upper section 2. On the lower wedge section 5, near the thick wedge end, a step-shaped crosspiece 9 is formed to hang the roofing plate 1 from a substructure made of battens. The crosspiece 9 goes over into the wedge section 5 along a curve.

The underside 10 of the lower section 4 is an extension of the underside 8. The upper side of the lower section 4 comprises an open channel 11 extending transversely of the plate. The channel 11 is bounded below by a crosspiece 12 and on the top by a crosspiece 13, which constitutes the upper edge of the lower section 4.

The channel 11 bottom, in the form of a curved trough extends between the crosspieces 12 and 13, whereby the radius of the channel increases towards the crosspiece 13. Crosspiece 12 is higher overall than crosspiece 13 and has a flattened zone 14 extending towards the edge and a projection 15 which constitutes an extension of the channel curve of an adjoining plate (see FIG. 4).

Figure 2:
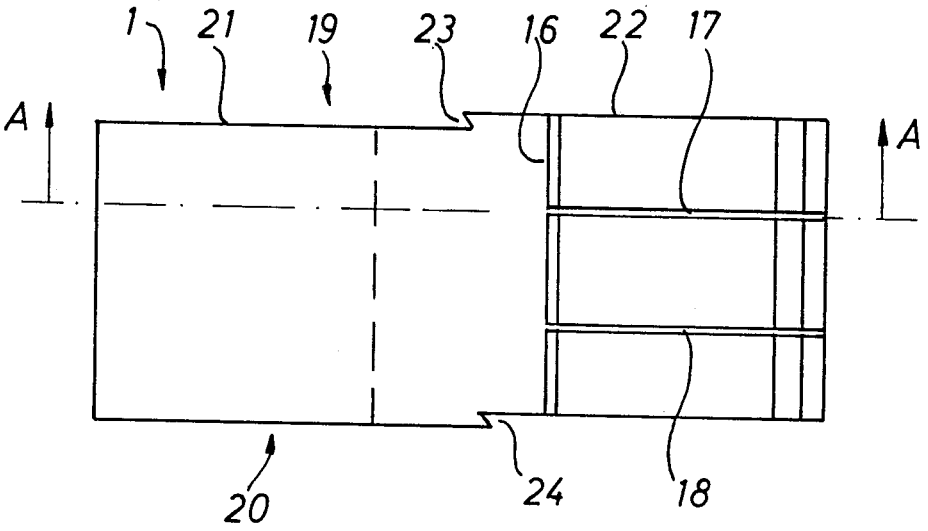
FIG. 2 is a top plan view of the roofing plate of the invention.

FIG. 2 shows a top view of a roofing plate 1, whereby the three areas, upper section 2, central section 3 and lower section 4 can again be recognized. Drainage channels 17, 18, starting at the lowest step point 16 extend through the crosspieces 12 and 13, transversely to channel 11, to the plate edge on the eaves side. Only two drainage channels 17, 18 are shown here, but a greater number can be provided as required, so that the crosspieces 12, 13 appear as separate humps or ridges.

The longitudinal lateral surfaces 19, 20 are offset, whereby an upper side area 21, on the right side as seen from above, is offset to the left with respect to a lower left side area 22, so that obliquely formed hooks 23, 24 result. Hook 24 is slightly lower in direction of the eaves than hook 23. When an adjoining plate engages, with its hook 24, the hook 23 of the shown plate, and when traction is exerted upon the second plate, as for instance when the channel is filled with soil, the two hooks press tightly into each other.

Figure 3:
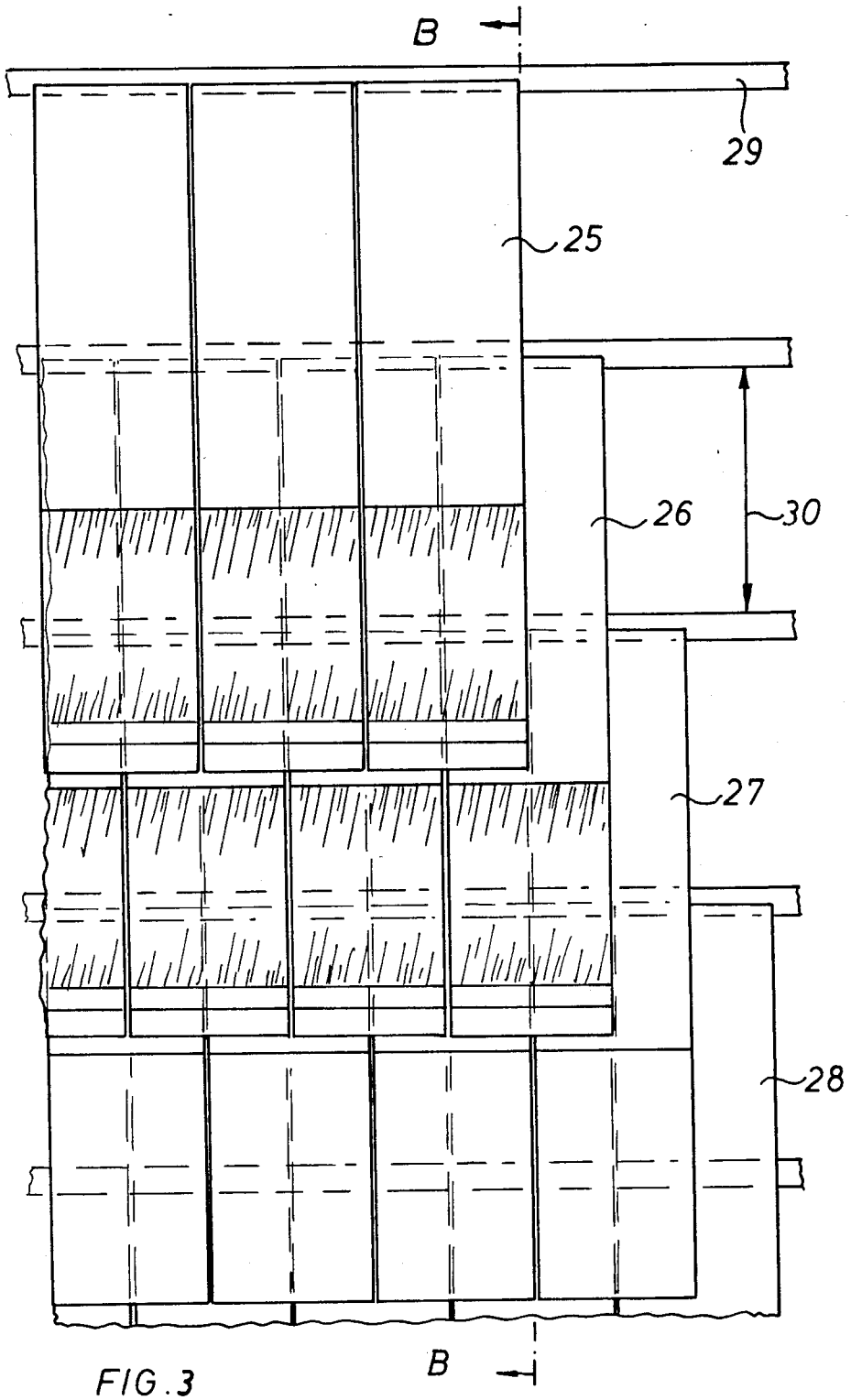
FIG. 3 is a top view of a plurality of installed roofing plates.
Figure 4:
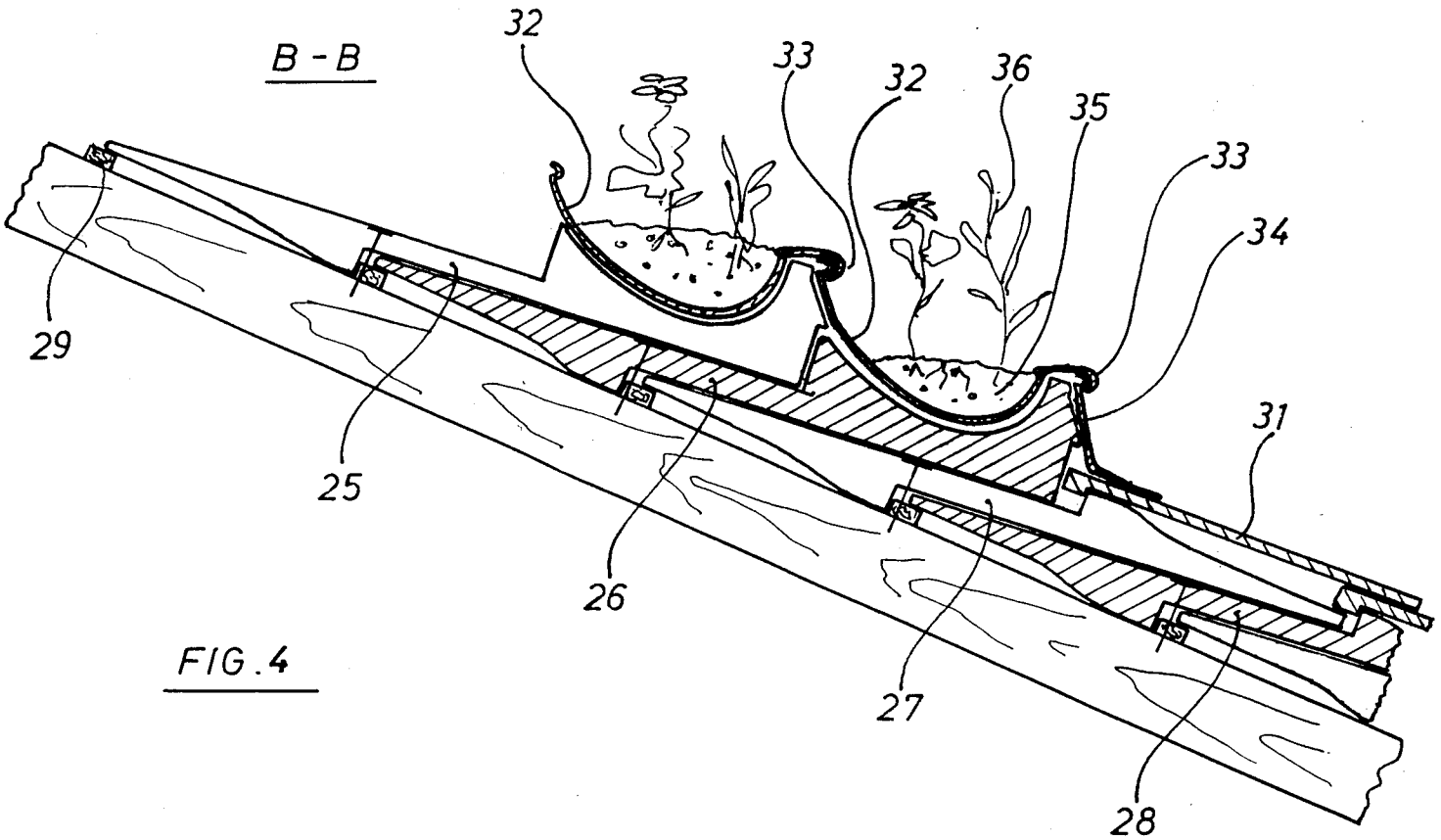
FIG. 4 is a cross-section and side view, taken along line B—B of FIG. 3, of a plurality of installed roofing plates.

The type of covering, greenery and the function of the roofing plate according to invention is explained in further detail through FIGS. 3 and 4.

In FIG. 3, four rows 25, 26, 27, 28 of roofing plates 1 are shown installed on a sub-structure consisting of roof battens 29 (the roofing plates are shown without lateral hooks 23, 24). It can be seen that the upper section 2 and the lower section 4 are somewhat longer than the interval 30 between the roof battens 29, and that the central section 3 measures approximately half the batten interval 30, so that a wide overlap of the lower plates results. This can also be seen from FIG. 4, which shows a section along line B—B of FIG. 3, but where additional shell sections 32 are already planted with greenery and where additional plates are shown with a roofing cover.

Water tightness is achieved through offset installation of the roofing plate rows 25 to 28 and through the wide overlapping.

It can be seen from FIG. 4 that the individual rows 25 to 28 of roofing plates would be pushed together or pushed apart slightly with somewhat wider or narrower batten intervals 30. Because of the wedge-shaped overlaps, no difficulties would be created by this and the average, effective insulating layer thickness achieved with the plates would change only imperceptibly.

The two lower roofing plate rows 27, 28 are made with plates in which the lower section is also wedge-shaped, with roofing plates 31 hung from them. The roofing plates according to the instant application can, therefore, be combined with roofing plates such as these without any difficulty.

The roofing plate rows 25 and 26 are equipped with the channel structures according to the invention to provide support for strips of greenery. Shell sections 32 are inserted into the formed channels and are provided with beads and creases 33 which hook into each other from above and thus constitute a strong, water-tight connection. An additional connecting element 34 is shaped to connect to the roofing plate 31.

The shell sections 32 are filled with a nutritive medium 35 for greenery 36.

It can be concluded from the above that the roofing plates according to invention provide elements by means of which greenery can be planted on a roof surface, can be achieved simply and inexpensively, especially in combination with a heat insulating, water-tight sub-roof.

We claim:

1. A roofing plate for supporting plants on roofs, having means for heat insulating said roof and means for containing a nutritive medium for growing plants, comprising:

(a) an upper section having a wedge-shaped tapering cross-section, decreasing in thickness towards its upper edge;

(b) a central section integral with said upper section having a uniform cross-sectional thickness, said thickness being less than the cross sectional thickness of the thickest portion of said upper section; and (c) a lower section, integral with said central section, having at least one open channel on its upper surface extending transversely of said plate, said channel defined by a first cross piece at its lower edge and a second cross piece separating the lower section of said plate from said central section, said first cross piece being higher than said second cross piece.

2. A roofing plate for supporting plants on roofs, having means for heat insulating said roof and means for containing a nutritive medium for growing plants, comprising:

(a) an upper section having a wedge-shaped tapering cross-section, decreasing in thickness towards its upper edge;

(b) a central section integral with said upper section having a uniform cross-sectional thickness, said thickness being less than the cross sectional thickness of the thickest portion of said upper section; and (c) a lower section, integral with said central section, having said containing means, said containing means having at least one open channel on and being integral with the upper surface of said lower section, said channel extending transversely of said plate for containing said nutritive medium for growing plants, wherein the combined lengths of the central section and the lower section is greater than the length of said upper section.

3. A roofing plate as set forth in claim 2, wherein said wedge-shaped cross-section defines a step shaped cross-piece on the lower surface of said upper section adjacent the point where said upper section joins said central section, whereby the roofing plate can be hung from a sub-structure of said roof.

4. A roofing plate as set forth in claim 2, wherein the cross-piece at the lower edge of said plate is bevelled at an angle sloping in direction of said lower edge.

5. A roofing plate as set forth in claim 2, wherein the lengths of said upper section and said lower section each measure between 32 centimeters and 38 centimeters, and the length of said central section measures one-half the length of said upper section.

6. A roofing plate as set forth in claim 2, wherein said open channel is defined by a cross-piece at the lower edge of said lower section and a second cross-piece separating the lower section of said plate from said central section of said plate.

7. A roofing plate as set forth in claim 6, wherein the channel between said cross-pieces is trough-shaped.

8. A roofing plate as set forth in claim 7, wherein the radius of the cross-section of said trough-shaped channel is shorter towards said lower edge.

9. A roofing plate as set forth in claim 6, wherein at least one drainage channel extends on the upper surface of said lower section transversely of said open channel and through said cross-pieces to provide drainage longitudinally of said plate.

10. A roofing plate as set forth in claim 2, wherein said open channel is provided with a shell of water impervious material.

11. A roofing plate as set forth in claim 10, wherein said shell is made of sheet metal.

12. A roofing plate as set forth in claim 10, wherein said shell covers the entire surface of said open channel and of said cross-pieces.

13. A roofing plate for supporting plants on roofs, having means for heat insulating said roof and means for containing a nutritive medium for growing plants, comprising:

(a) an upper section having a wedge-shaped tapering cross-section, decreasing in thickness towards its upper edge;

(b) a central section integral with said upper section having a uniform cross-sectional thickness, said thickness being less than the cross sectional thickness of the thickest portion of said upper section;

(c) a lower section, integral with said central section, having at least one open channel on its upper surface extending transversely of said plate for containing said nutritive medium for growing plants, wherein the combined lengths of the central section and the lower section is greater than the length of said upper section; and (d) step-shaped indentations in the lateral edges of said plate for interlocking with similar indentations of adjacent plates to provide improved wind tightness when said plate are used on said roof.

* * * * *